US009770099B2

(12) United States Patent
Chen

(10) Patent No.: US 9,770,099 B2
(45) Date of Patent: Sep. 26, 2017

(54) READILY RELEASABLE LOCKING DEVICE FOR A DESK

(71) Applicant: ARTSO INTERNATIONAL, INC., Taipei (TW)

(72) Inventor: Kuo-Hung Chen, Taipei (TW)

(73) Assignee: Artso International, Inc., Taipei (TW)

( * ) Notice: Subject to any disclaimer, the term of this patent is extended or adjusted under 35 U.S.C. 154(b) by 50 days.

(21) Appl. No.: 14/709,994

(22) Filed: May 12, 2015

(65) Prior Publication Data

US 2015/0327670 A1 Nov. 19, 2015

(30) Foreign Application Priority Data

May 14, 2014 (TW) ..... 103208392 U

(51) Int. Cl.
*A47B 13/08* (2006.01)
*G05G 5/22* (2006.01)

(52) U.S. Cl.
CPC ..... *A47B 13/081* (2013.01); *A47B 13/088* (2013.01); *G05G 5/22* (2013.01); *Y10T 74/2042* (2015.01); *Y10T 74/20438* (2015.01); *Y10T 74/20648* (2015.01)

(58) Field of Classification Search
CPC ..... A47B 13/088; A47B 27/18; A47B 41/02; A47B 13/081; A47B 2200/0043; A47B 19/06; G05G 5/22
See application file for complete search history.

(56) References Cited

U.S. PATENT DOCUMENTS 2,180,209 A * 11/1939 Johnson ..... G05G 5/22 74/531
8,967,579 B2 * 3/2015 Tsai ..... A47B 27/18 248/188.1

* cited by examiner

*Primary Examiner* — Thomas C Diaz
(74) *Attorney, Agent, or Firm* — LeClairRyan

(57) ABSTRACT

Disclosed is a readily releasable locking device for guarding a movement of an angularly movable flat board relative to an elongated shell. The readily releasable locking device includes a latch member operable to retain or release a guided rod that can be retained at various positions to permit the flat board to be tilted at different angles. Also disclosed is a readily releasable locking device for guarding against a movement of the elongated shell that is linearly movable relative to a non-movable tubular core member.

7 Claims, 20 Drawing Sheets

READILY RELEASABLE LOCKING DEVICE FOR A DESK

CROSS-REFERENCE TO RELATED APPLICATION

This application claims priority from Taiwanese application no. 103208392, filed on May 14, 2014, the disclosure of which is incorporated in its entirety herein by reference.

FIELD

The disclosure relates to a readily releasable locking device for a desk, more particularly to a readily releasable locking device for guarding against an angular or linear movement of a desk top which is disposed to make a continuous angular or linear movement.

BACKGROUND

A conventional locking device for a desk with a tiltable desk top has first and second segments which are telescopically connected to each other, and which can be locked to each other at a plurality of predetermined locking positions. The first segment has a first connection end which is opposite to the second segment, and which is connected to a lower surface of the desk top. The second segment has a second connection end which is opposite to the first segment, and which is connected to a desk leg. By adjusting the length of the locking device, the tilt angle of the desk top can be adjusted.

SUMMARY

An object of the disclosure is to provide a novel readily releasable locking device for a desk, which can guard against an angular or linear movement of a desk top (a flat board) which is disposed to make a continuous angular or linear movement.

According to a first aspect of the disclosure, there is provided a readily releasable locking device for guarding against an angular movement of an angularly movable flat board relative to a non-angularly movable elongated shell. The angularly movable flat board is disposed to make continuous angular displacement relative to the non-angularly movable elongated shell between a laid-flat position and a lifted-up position. The readily releasable locking device includes first and second link bars, a hollow block, a guided rod, a latch member, a biasing member, and an actuating unit. The first link bar is adapted to be fixed on the angularly movable flat board and has a first pivot end distal from the angularly movable flat board. The second link bar is adapted to be fixed on the non-angularly movable elongated shell and has a second pivot end distal from the non-angularly movable elongated shell. The hollow block is pivotally mounted to the second pivot end about a second pivot axis, and has a guiding slot which extends transverse to the second pivot axis. The guided rod has a connected end pivotally mounted to the first pivot end about a first pivot axis parallel to the second pivot axis, and a rod body extending from the connected end along a lengthwise line to terminate at a free end. The rod body is led to pass through the guiding slot and to extend outwardly of the hollow block, so as to permit the guided rod to be moved relative to the hollow block between a proximate position, where the hollow block is proximate to the first pivot end, and which corresponds to the laid-flat position of the angularly movable flat board, and a distal position, where the hollow block is distal from the first pivot end, and which corresponds to the lifted-up position of the angularly movable flat board. The latch member is disposed in the hollow block and is coupled with the guided rod such that the latch member is displaceable between a first orientation, where the guided rod is retained by the latch member, and a second orientation, where the guided rod is permitted to move relative to the latch member. The biasing member is disposed in the hollow block to bias the latch member to the first orientation. The actuating unit is configured to actuate the latch member to move from the first orientation to the second orientation.

According to a second aspect of the disclosure, there is provided a readily releasable locking device for guarding against a linear movement of a linearly movable elongated shell relative to a non-movable tubular core member. The linearly movable elongated shell is slidably fitted on the non-movable tubular core member, and is disposed to make continuous linear displacement relative to the non-movable tubular core member between a retracted position and an extended position. The readily releasable locking device includes an under mounting frame, front and rear mounting frames, a guiding bar, a hollow block, a connecting rod, a latch member, a biasing member, and an actuating unit. The under mounting frame is adapted to be secured to the linearly movable elongated shell. The front and rear mounting frames are adapted to be secured to the non-movable tubular core member and are spaced apart from each other in a forward-and-rearward direction. The guiding bar extends in the forward-and-rearward direction to terminate at front and rear ends which are secured to the front and rear mounting frames, respectively. The hollow block is configured to be guided by and movable relative to the guiding bar between a rear position, where the hollow block is close to the rear mounting frame, and which corresponds to the retracted position of the linearly movable elongated shell, and a front position, where the hollow block is remote from the rear mounting frame, and which corresponds to the extended position of the linearly movable elongated shell. The connecting rod extends through the front mounting frame to connect the under mounting frame and the hollow block, thereby permitting the hollow block to be moved with the linearly movable elongated shell. The latch member is disposed in the hollow block and is coupled with the guiding bar such that the latch member is displaceable between a first orientation, where the latch member together with the hollow block is retained on the guiding bar, and a second orientation, where the latch member together with the hollow block is permitted to move relative to the guiding bar. The biasing member is disposed in the hollow block to bias the latch member to the first orientation. The actuating unit is configured to actuate the latch member to move from the first orientation to the second orientation.

BRIEF DESCRIPTION OF THE DRAWINGS

Other features and advantages of the disclosure will become apparent in the following detailed description of the embodiments with reference to the accompanying drawings, in which.

DETAILED DESCRIPTION

Figure 1:
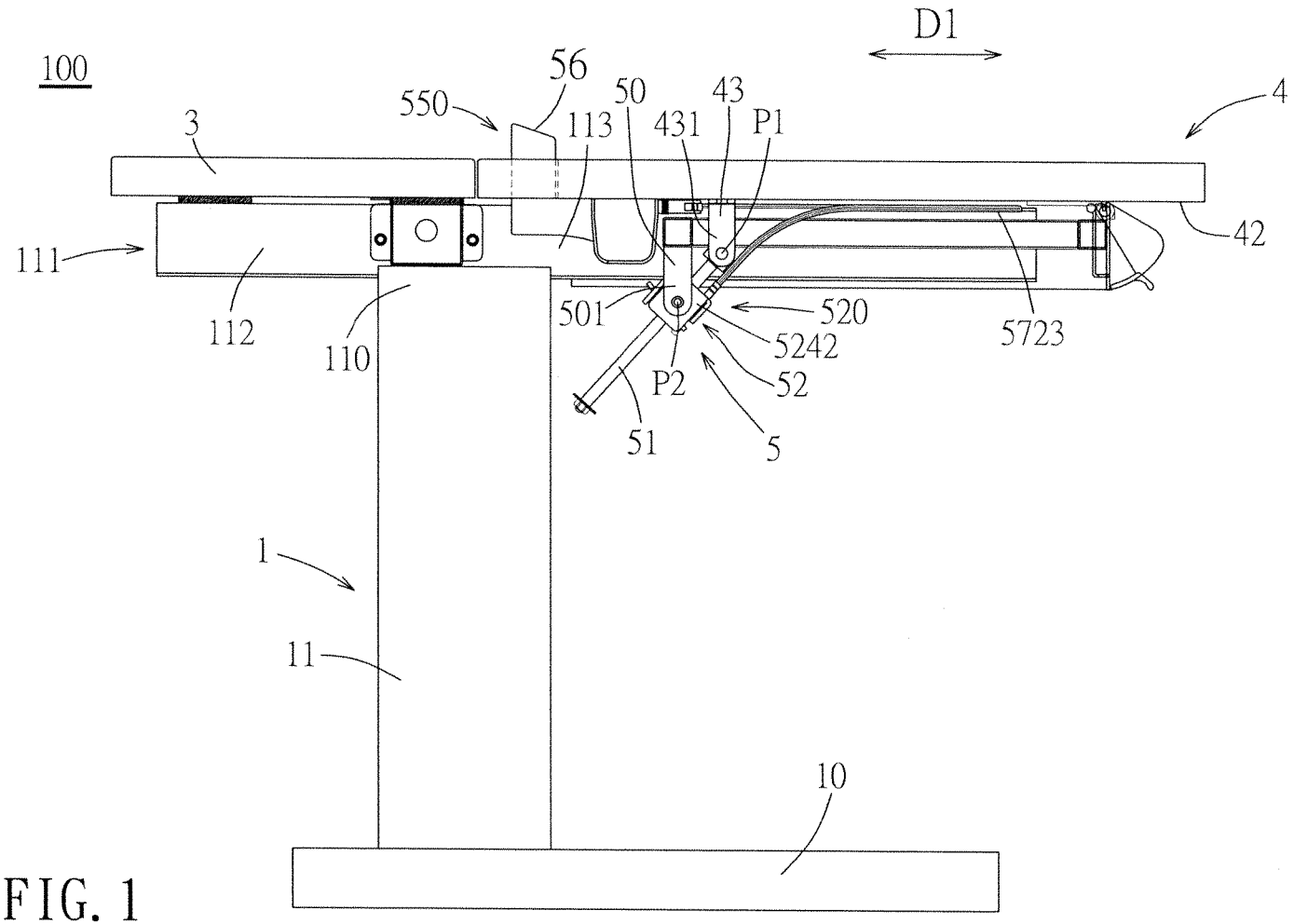
FIG. 1 is a schematic side view primarily showing a first readily releasable locking device according to a first embodiment of the disclosure when used in a desk.
Figure 2:
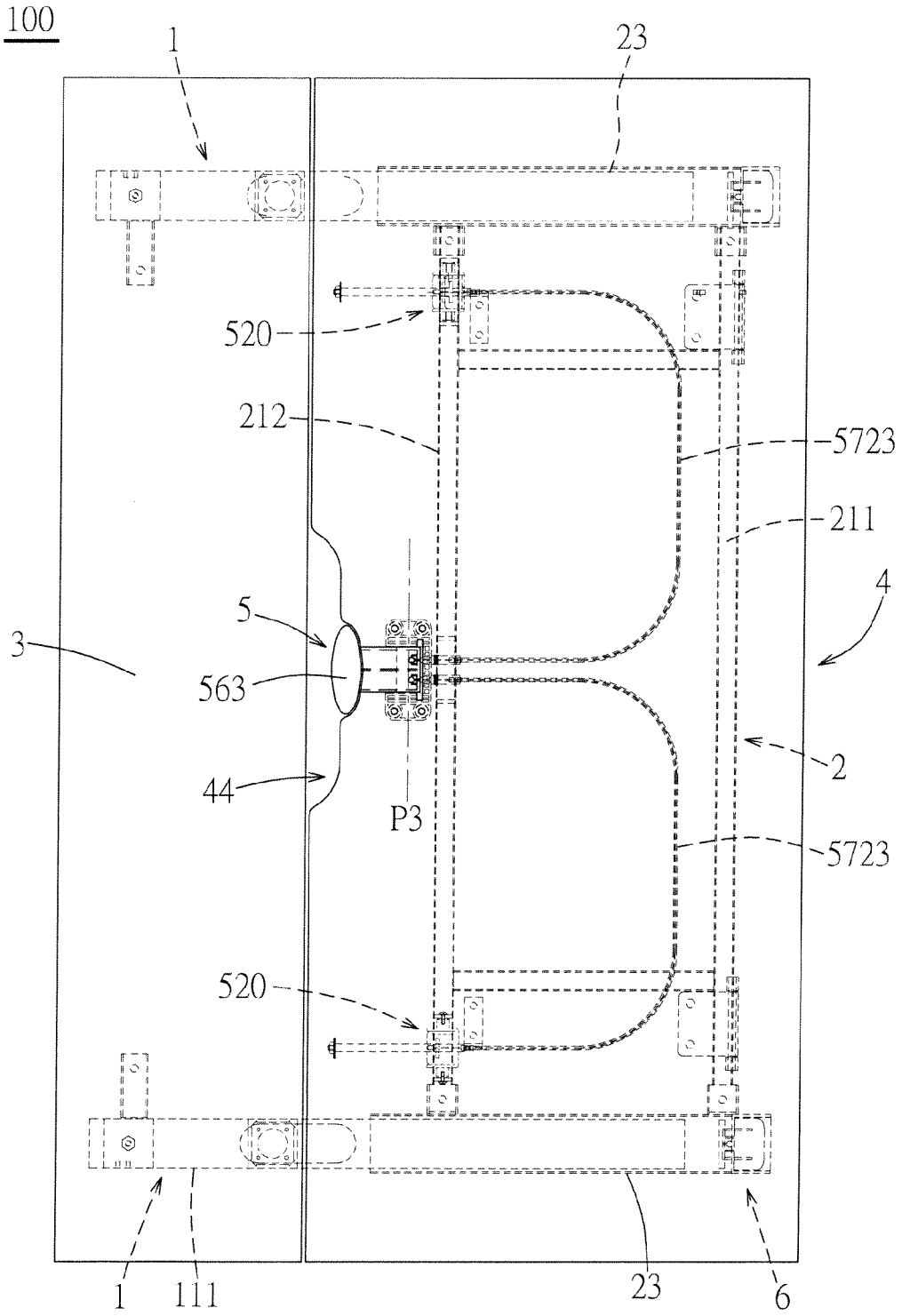
FIG. 2 is a schematic top view primarily showing the first readily releasable locking device.

Before the disclosure is described in greater detail, it should be noted that like elements are denoted by the same reference numerals throughout the disclosure.

FIGS. 1, 2, 3, and 13 illustrate first and second readily releasable locking devices 5, 6 according to a first embodiment of the disclosure for use in an article of furniture such as a desk 100. The desk 100 includes a desk support 1, a non-movable flat board 3, a movable flat board 4, and an elongated shell 23.

The desk support 1 is non-movable, and includes a desk base 10, a supporting leg 11 extending upwardly from the desk base 10 to terminate at an upper leg end 110, and a tubular core member 111 supported on the upper leg end 110. The tubular core member 111 has front and rear segments 113, 112 which are opposite to each other in a forward-and-rearward direction (D1). The non-movable flat board 3 is mounted on the rear segment 112 of the tubular core member 111.

The elongated shell 23 is not angularly movable, and is slidably fitted on the tubular core member 111. The elongated shell 23 is disposed to make continuous linear displacement relative to the tubular core member 111 in a forward-and-rearward direction (D1) between a retracted position (see FIG. 13) and an extended position (see FIG. 22).

Figure 12:
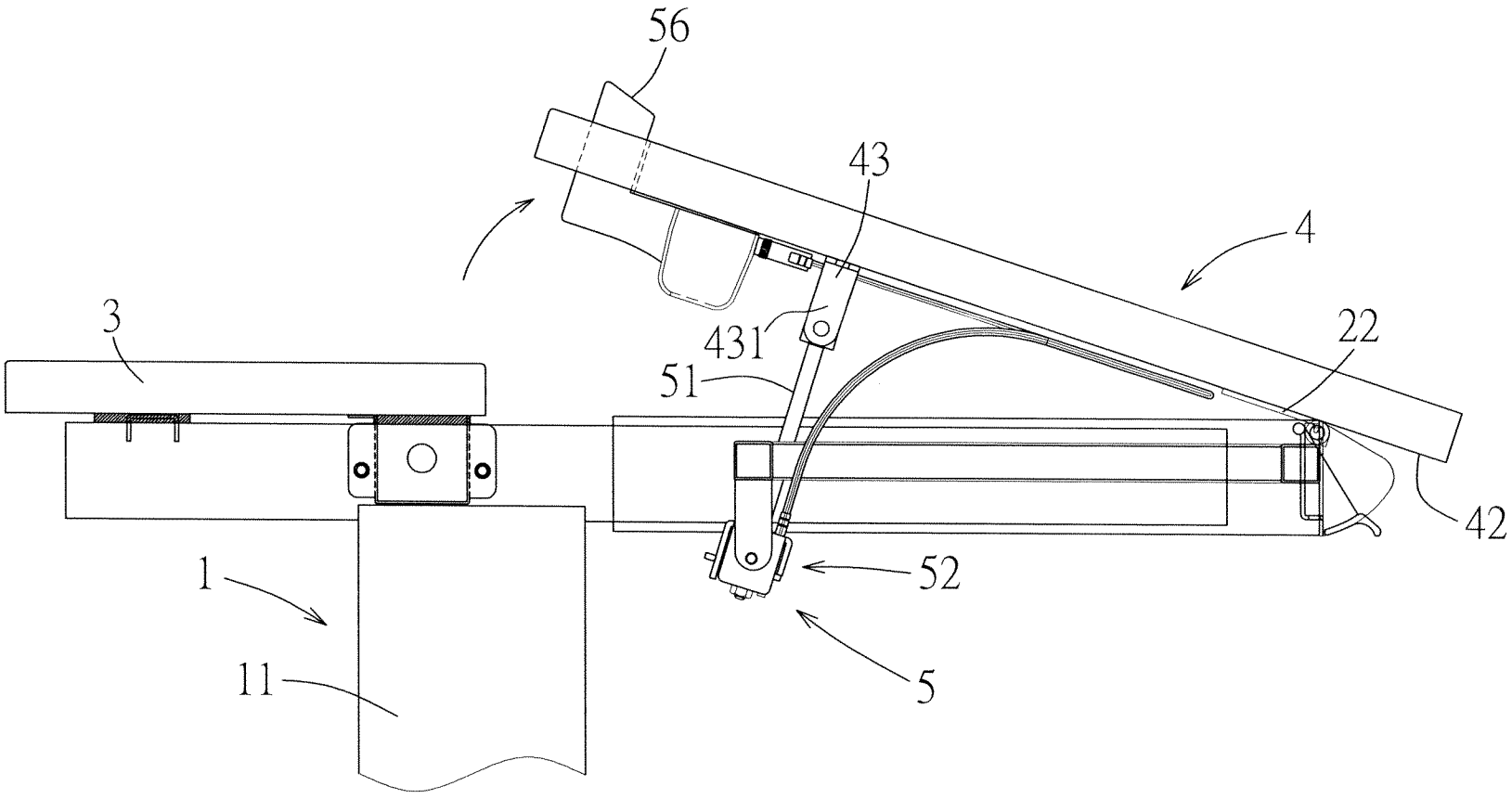
FIG. 12 is similar to FIG. 1 but showing the angularly movable flat board in a lifted-up position.
Figure 13:
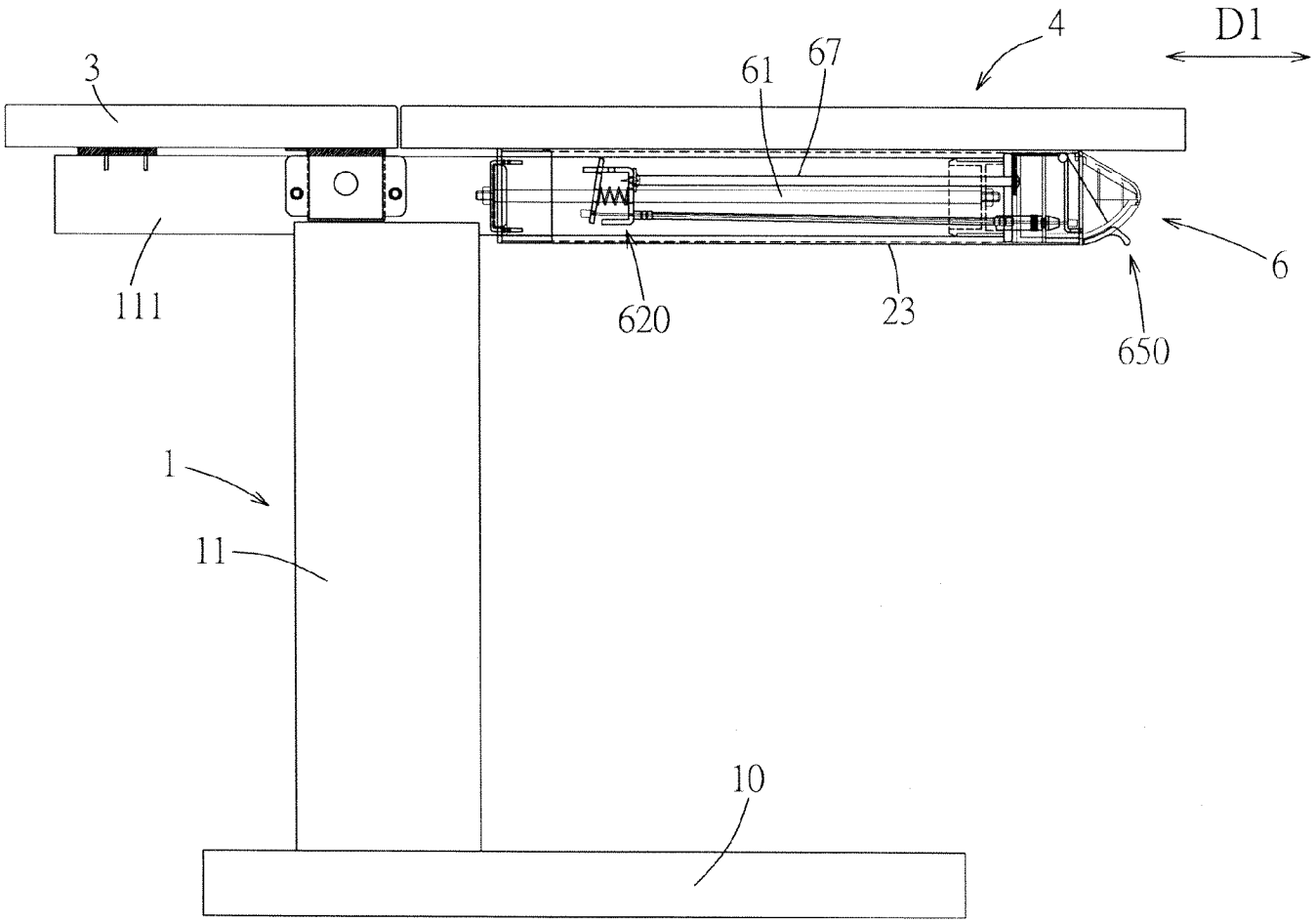
FIG. 13 is a schematic side view primarily showing a second readily releasable locking device according to the first embodiment of the disclosure when used in a desk.
Figure 14:
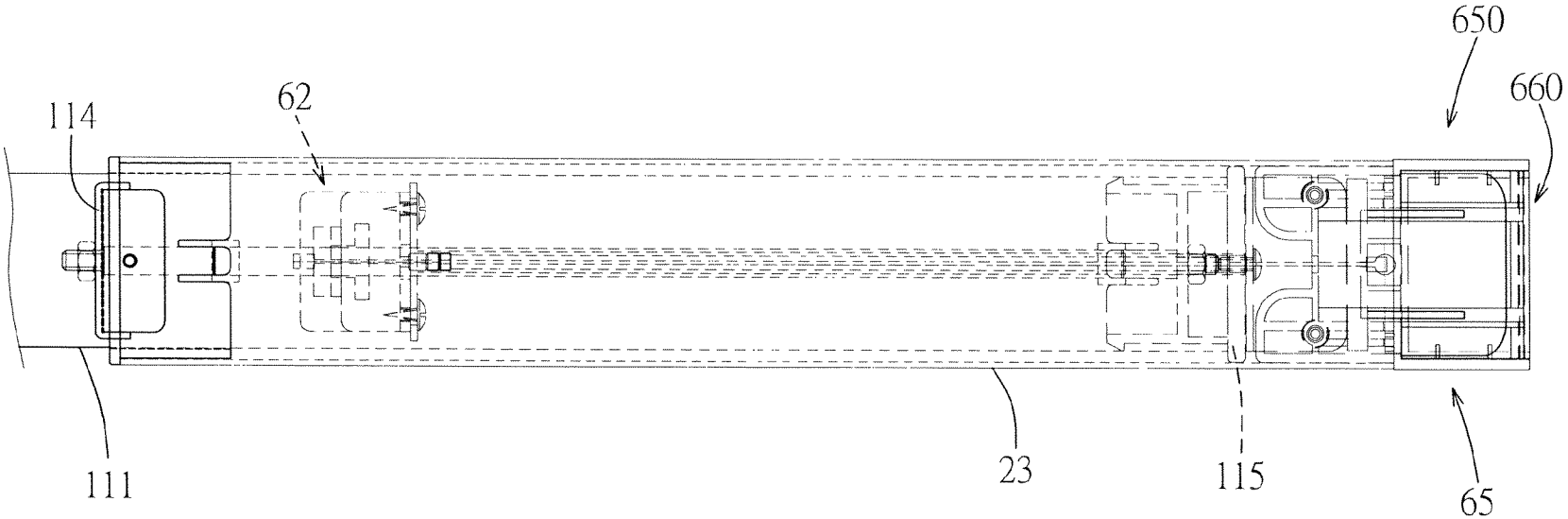
FIG. 14 is a schematic fragmentary top view primarily showing the second readily releasable locking device of FIG. 13.
Figure 22:
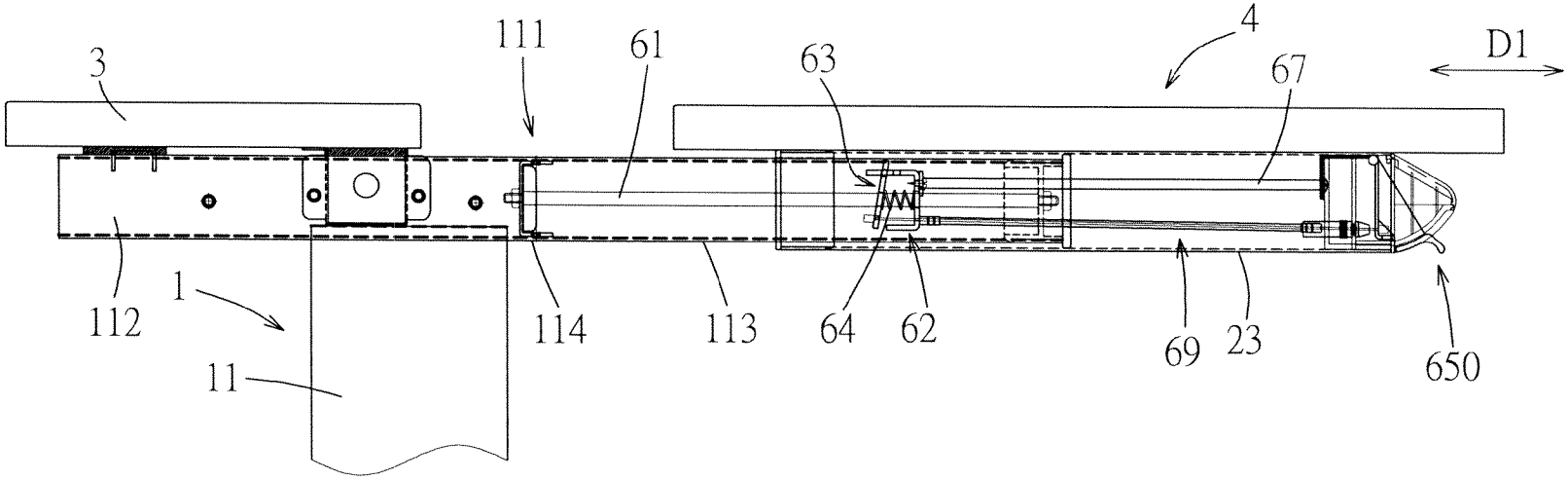
FIG. 22 is similar to FIG. 13 but showing a linearly movable elongated shell in an extended position.

The movable flat board 4 is linearly moved with the elongated shell 23 when the elongated shell 23 is moved linearly (see FIG. 22). In addition, the movable flat board 4 is disposed to make continuous angular displacement relative to the elongated shell 23 between a laid-flat position (see FIG. 1) and a lifted-up position (see FIG. 12).

Figure 3:
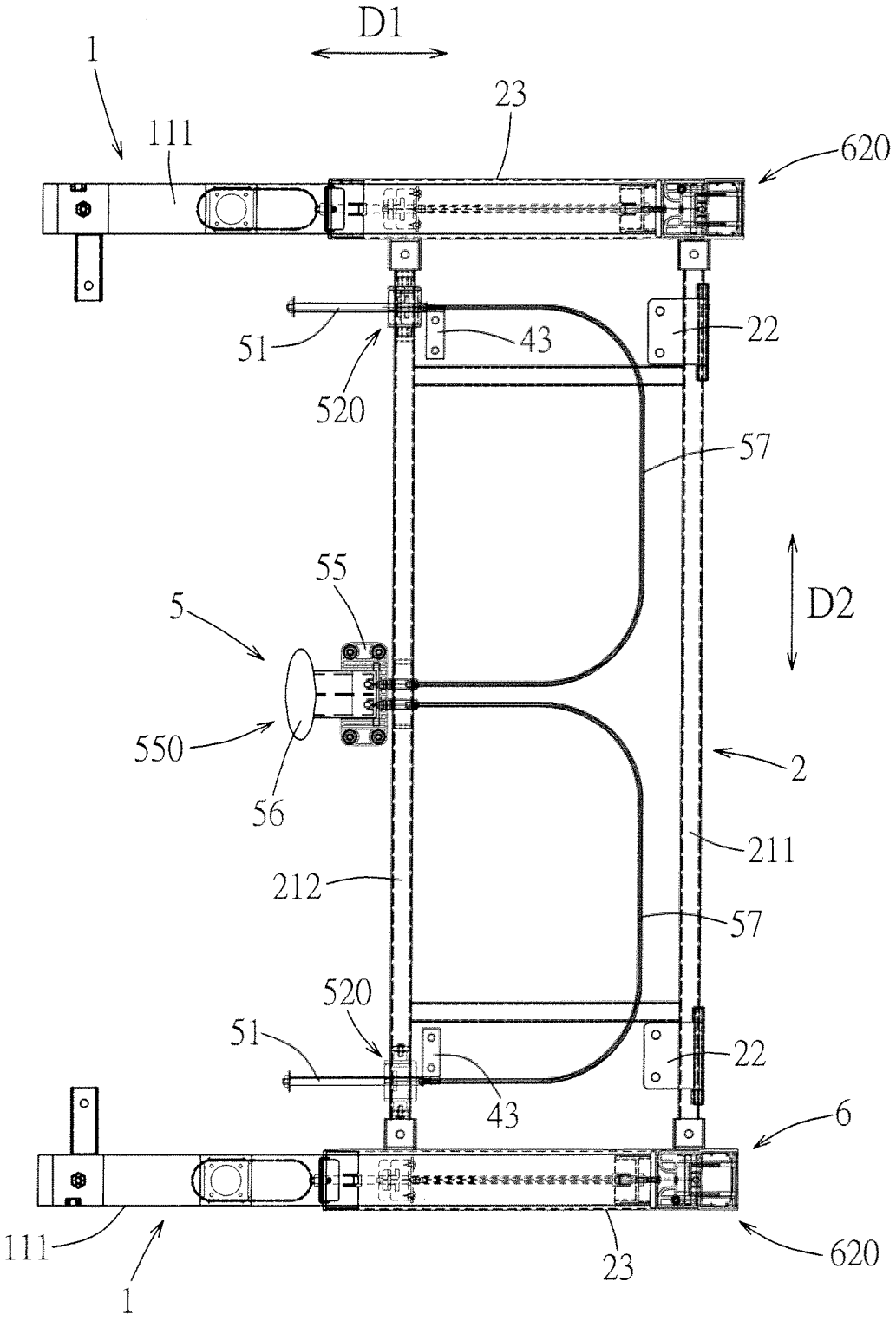
FIG. 3 is similar to FIG. 2 but with a non-movable flat board and an angularly movable flat board omitted.
Figure 4:
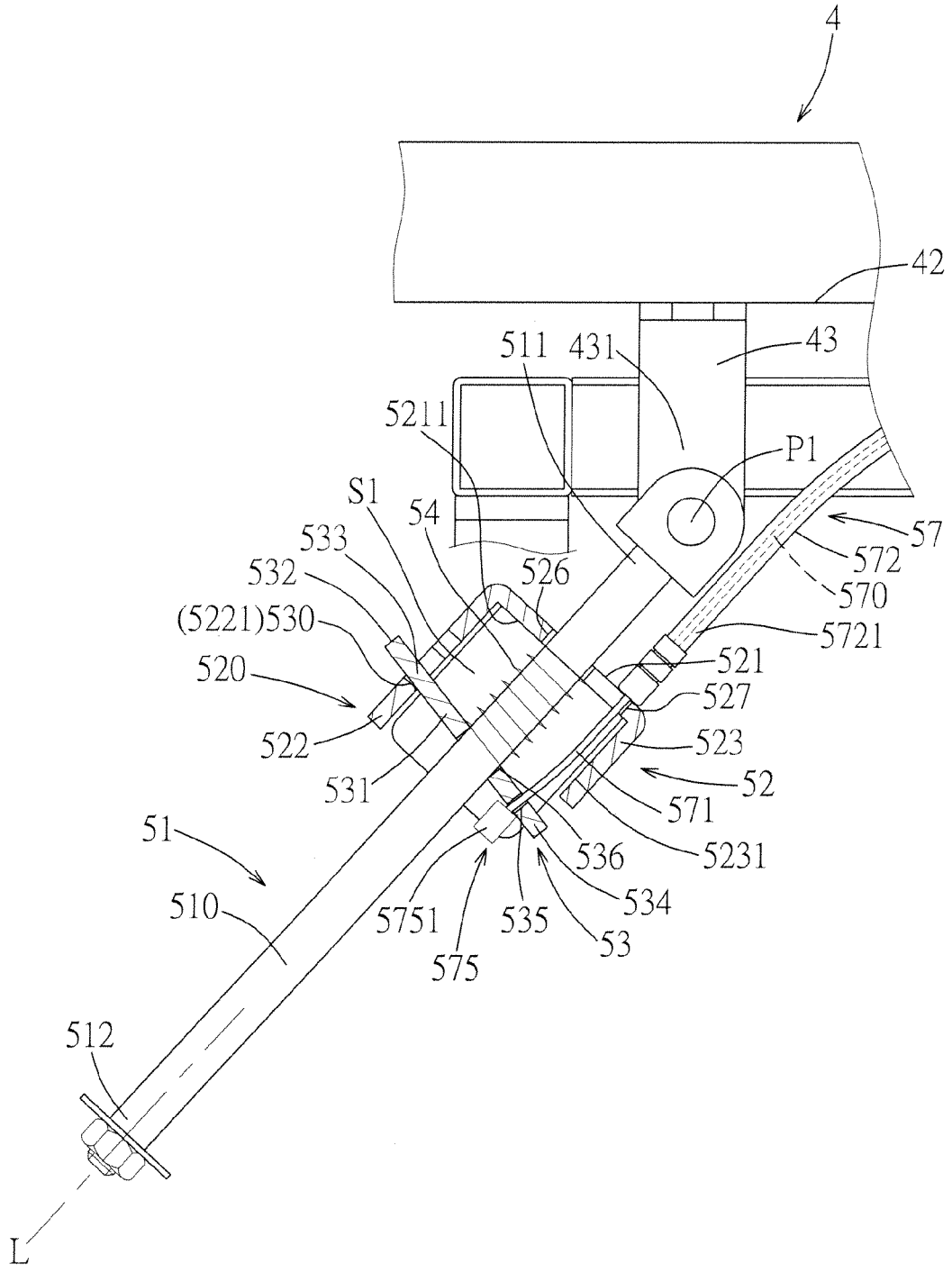
FIG. 4 is a fragmentary enlarged sectional view of the first readily releasable locking device shown in FIG. 1.

The first readily releasable locking device 5 is used for guarding against an angular movement of the movable flat board 4 relative to the elongated shell 23. As best shown in FIGS. 1, 3, and 4, the first readily releasable locking device 5 includes a first locking unit 520 and a first actuating unit 550. The first locking unit 520 includes first and second link bars 43, 50, a first hollow block 52, a guided rod 51, a first latch member 53, and a first biasing member 54.

The first link bar 43 is fixed on the flat board 4 and has a first pivot end 431 distal from the flat board 4. The second link bar 50 is fixed on the elongated shell 23 and has a second pivot end 501 distal from the elongated shell 23.

The first hollow block 52 is pivotally mounted to the second pivot end 501 about a second pivot axis (P2), and has a guiding slot 526 (see FIGS. 4 and 5), which extends transverse to the second pivot axis (P2).

As best shown in FIG. 4, the guided rod 51 defines a lengthwise line (L), and has a connected end 511 pivotally mounted to the first pivot end 431 about a first pivot axis (P1) parallel to the second pivot axis (P2), and a rod body 510 extending from the connected end 511 along the lengthwise line (L) to terminate at a free end 512. The rod body 510 extends through the guiding slot 526 and outwardly of the first hollow block 52 such that the guided rod 51 is guided by the guiding slot 526 and is movable relative to the first hollow block 52 between a proximate position (see FIG. 4), where the first hollow block 52 is proximate to the first pivot end 431, and which corresponds to the laid-flat position of the flat board 4 (see FIG. 1), and a distal position (FIG. 12), where the first hollow block 52 is distal from the first pivot end 431, and which corresponds to the lifted-up position of the flat board 4.

The first latch member 53 is disposed in the first hollow block 52 and is coupled with the guided rod 51 such that the first latch member 53 is displaceable between a first orientation (see FIG. 4), where the guided rod 51 is retained by the first latch member 53, and a second orientation (FIG. 11), where the guided rod 51 is permitted to move relative to the first latch member 53.

Figure 5:
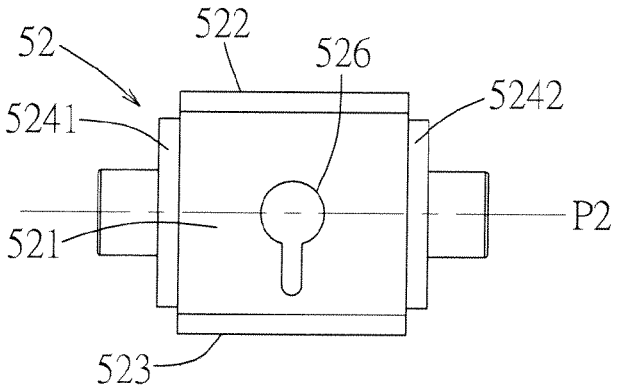
FIG. 5 is a side view of a first hollow block of the first readily releasable locking device.
Figure 6:
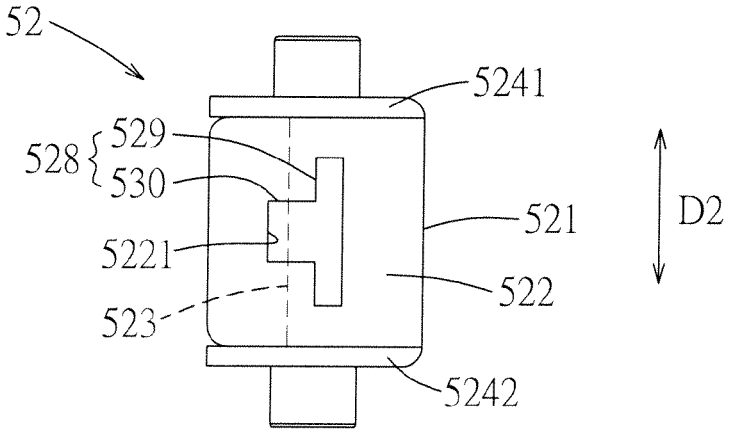
FIG. 6 is another side view of the first hollow block.

As shown in FIGS. 4 to 6, the first hollow block 52 has a top wall 521, a side support wall 522, and a side limit wall 523. The top wall 521 has an inner abutment surface 5211 and the guiding slot 526 which extends through the inner abutment surface 5211. The side support wall 522 defines an abutment surface 5221. The side limit wall 523 defines a limit surface 5231, and is spaced apart from the side support wall 522 by an accommodation space (S1).

Figure 7:
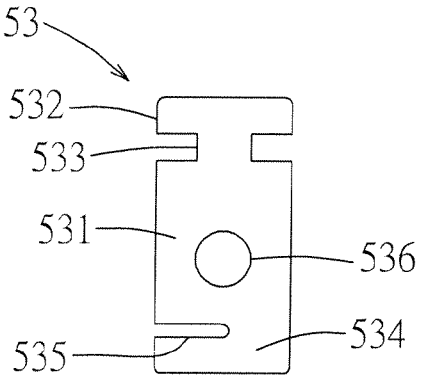
FIG. 7 is a plan view of a first latch member of the first readily releasable locking device.
Figure 11:
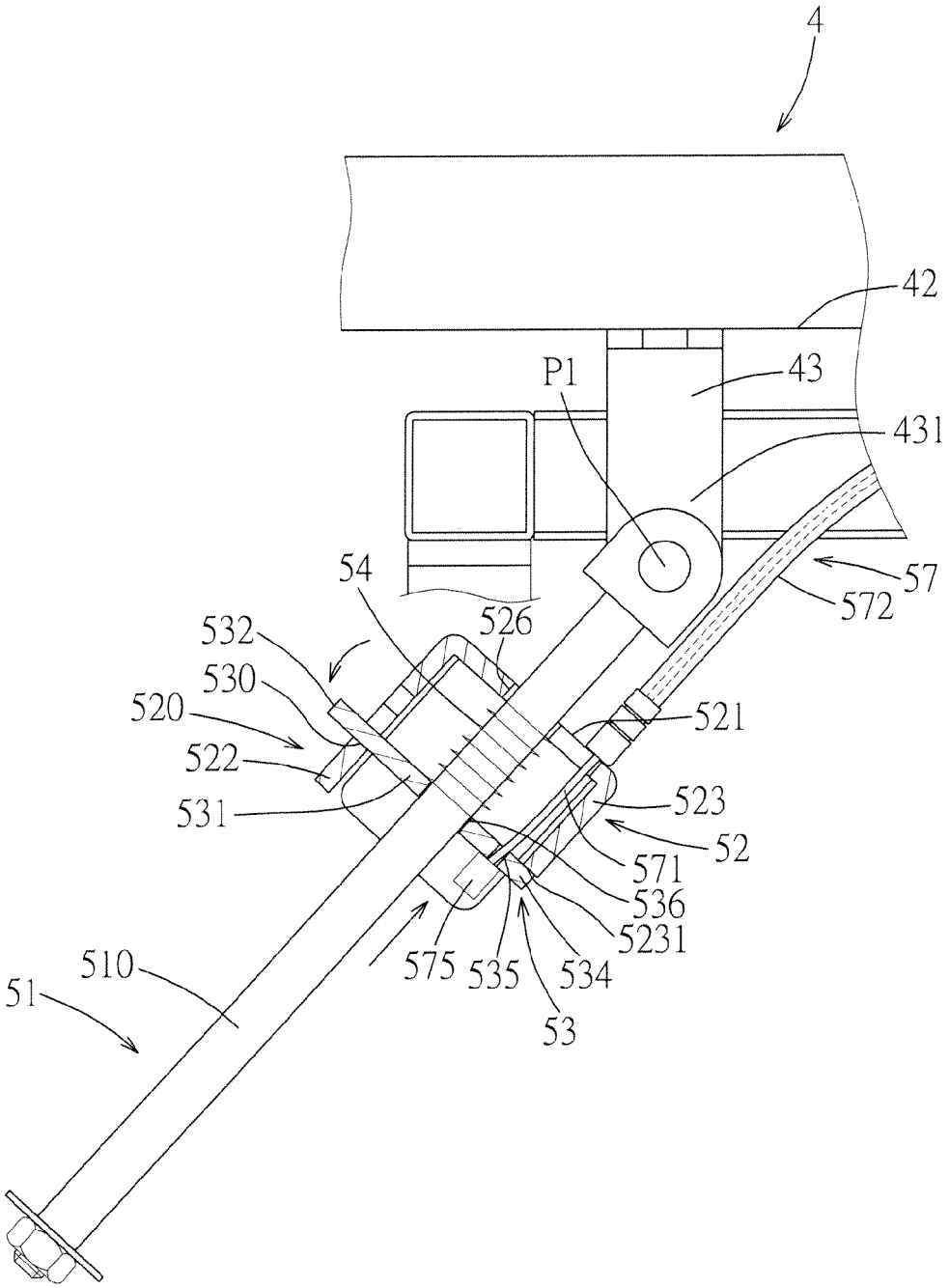
FIG. 11 is similar to FIG. 4 but showing the first latch member in a second orientation.

As shown in FIGS. 4 and 7, the first latch member 53 has a fulcrum region 533, a power region 534, and a weight region 531. The fulcrum region 533 is held on by the abutment surface 5221. The power region 534 is disposed to be actuated by the first actuating unit 550 to move between an engaged position (FIG. 11), where the power region 534 abuts against the limit surface 5231, and which corresponds to the second orientation of the first latch member 53, and a disengaged position (FIG. 4) which corresponds to the first orientation of the first latch member 53. The weight region 531 is disposed between the fulcrum region 533 and the power region 534, and has a gate hole 536 through which the guided rod 51 extends, and which is configured such that when the power region 534 is in the disengaged position, the rod body 510 is retained in the gate hole 536 (FIG. 4), and such that when the power region 534 is in the engaged position, the rod body 510 is released from being retained in the gate hole 536 (FIG. 11).

As best shown in FIGS. 1 and 6, the first latch member 53 further has left and right side walls 5241, 5242 opposite to each other in a left-and-right direction (D2) which is transverse to the forward-and-rearward direction (D1). One of the left and right side walls 5241, 5242 is pivotally mounted to the second pivot end 501.

With reference to FIGS. 4 and 7, the first latch member 53 further has a head region 532 which extends from the fulcrum region 533 and outwardly of the hollow block 52. The fulcrum region 533 is configured to be narrower than the head region 532 and the weight region 531 so as to serve as a neck of the first latch member 53. As shown in FIG. 6, the side support wall 522 has an engaging hole 528 which has a larger-dimension hole segment 529 and a smaller-dimension hole segment 530 bordered by the abutment surface 5221. The first latch member 53 is inserted into the accommodation space (S1) through the larger-dimension hole segment 529 such that the fulcrum region 533 is fitted into the smaller-dimension hole segment 530 to thereby be held on by the abutment surface 5221.

The first biasing member 54 is disposed in the first hollow block 52 to bias the first latch member 53 to the first orientation. In this embodiment, the first biasing member 54 is a spring sleeved on the rod body 510, and is disposed between the inner abutment surface 5211 and the weight region 531 to bias the first latch member 53 to the first orientation (FIG. 4).

Figure 9:
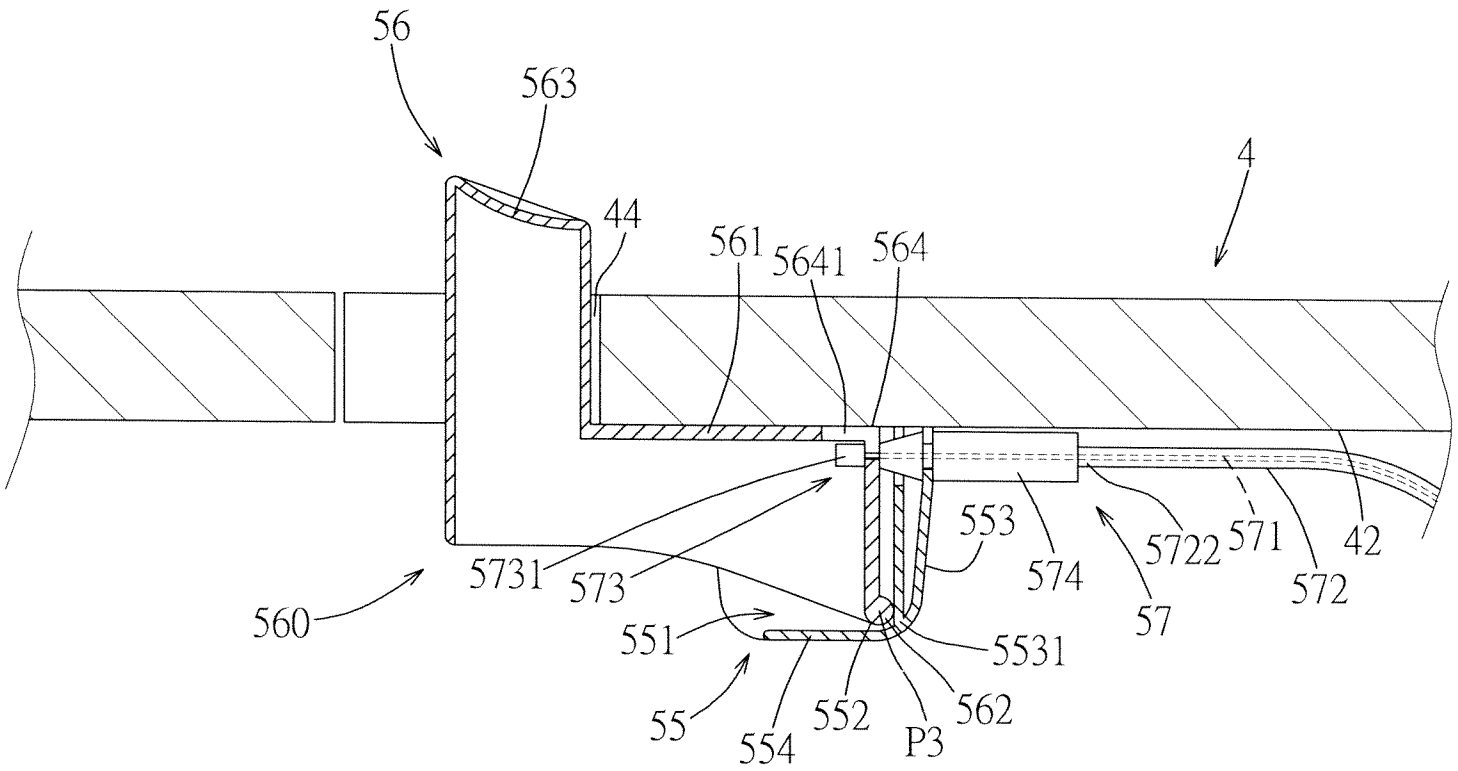
FIG. 9 is a cross-sectional view taken along line 9-9 of FIG. 8.

The first actuating unit 550 is configured to actuate the first latch member 53 to move from the first orientation to the second orientation. As best shown in FIGS. 3, 4, and 9, the first actuating unit 550 includes a cord member 57 and a manually operable actuator 56. The cord member 57 includes a pull cord 570. The pull cord 570 has a pulled end 573, and a cord body 571 extending from the pulled end 573 through the top wall 521 to terminate at an anchor end 575. The anchor end 575 is connected to the power region 534 of the first latch member 53. The manually operable actuator 56 is disposed to actuate the pulled end 573 to transmit a pulling force to the anchor end 575 so as to pull the power region 534 of the first latch member 53 from the disengaged position (FIG. 4) to the engaged position (FIG. 11).

In this embodiment, the anchor end 575 has an enlarged head 5751, and the power region 534 of the first latch member 53 is formed with a slit 535 for insertion of the cord body 571 so as to permit the enlarged head 5751 to be brought into abutting engagement with the power region 534, thereby allowing the power region 534 to be pulled to the engaged position.

Figure 10:
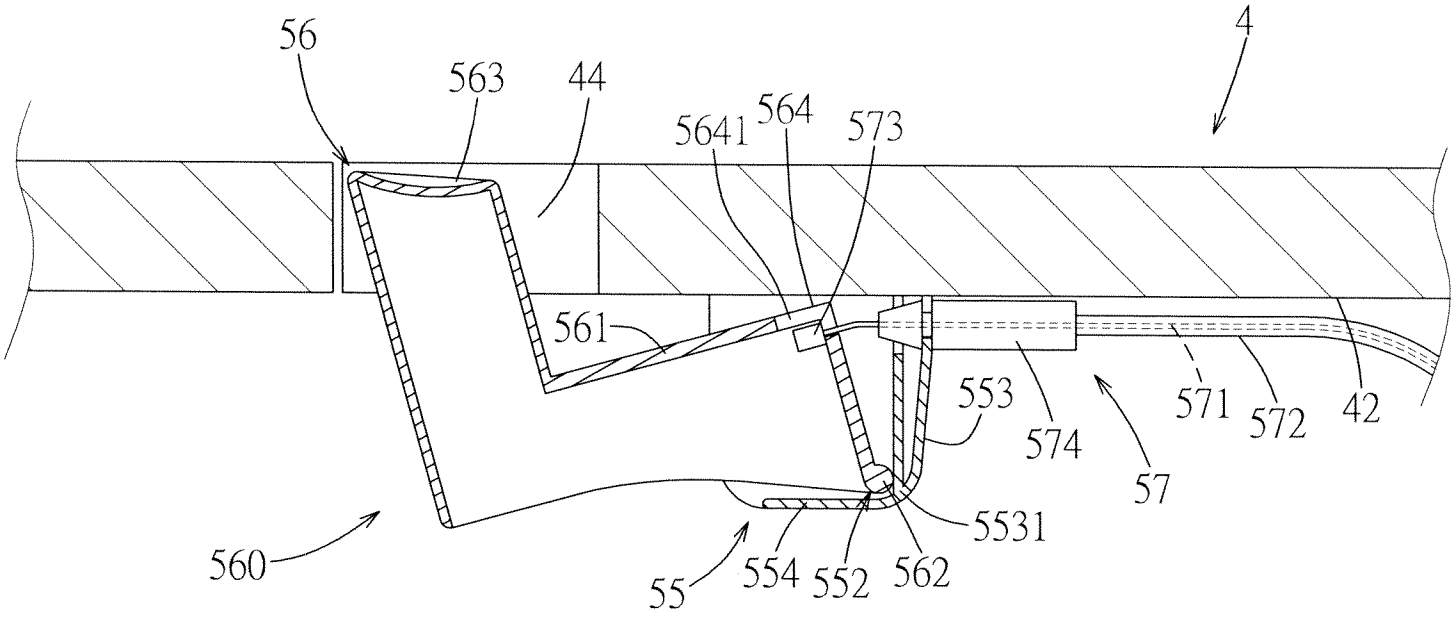
FIG. 10 is similar to FIG. 9 but showing a first actuating unit in a position to actuate the latch member.

With reference to FIGS. 9 and 10, the manually operable actuator 56 has a holding member 55 and an angular lever 560. The holding member 55 has an upright wall 553 and a mounting wall 554. The upright wall 553 extends downwardly from the movable flat board 4 to terminate at a lower end 5531, and is configured to permit the cord body 571 to be moved relative to the upright wall 553. The mounting wall 554 extends from the lower end 5531 transverse to the upright wall 553.

The angular lever 560 has a lever-fulcrum region 562 pivotally mounted to the mounting wall 554 about a third pivot axis (P3), a power end 563, and a weight end 564. The weight end 564 is angularly displaced from the power end 563 about the third pivot axis (P3), and is configured to anchor the pulled end 573 such that when the power end 563 is pushed to move angularly about the third pivot axis (P3), the weight end 564 is actuated to pull the pulled end 573. The angular lever 560 further has a web portion 561 which interconnects the power end 563 and the weight end 564 for reinforcement of the structure of the angular lever 560.

In addition, the weight end 564 is configured to have an engaging bore 5641 for insertion of the pulled end 573 therethrough. The pulled end 573 has an enlarged head 5731 which is anchored in the engaging bore 5641 when the weight end 564 is actuated to pull the pulled end 573.

In this embodiment, the cord member 57 further includes a tubular sheath 572, into which the cord body 571 is inserted loosely, and a tubular fitting 574 (see FIG. 9). As shown in FIGS. 4 and 9, the tubular sheath 572 has a block-side end 5721 disposed adjacent to the first hollow block 52, and a lever-side end 5722 disposed adjacent to the upright wall 553. The tubular sheath 572 is flexible for guiding and protecting the cord body 571 therein, and has a middle segment 5723, which is disposed between the block-side end 5721 and the lever-side end 5722, and which is secured to a bottom surface 42 of the flat board 4 (see FIGS. 1 and 12). The tubular fitting 574 extends through and is mounted in the upright wall 553. Besides, the tubular fitting 574 is rigid, and is configured to permit the cord body 571 to pass therethrough and to move relative thereto.

Figure 8:
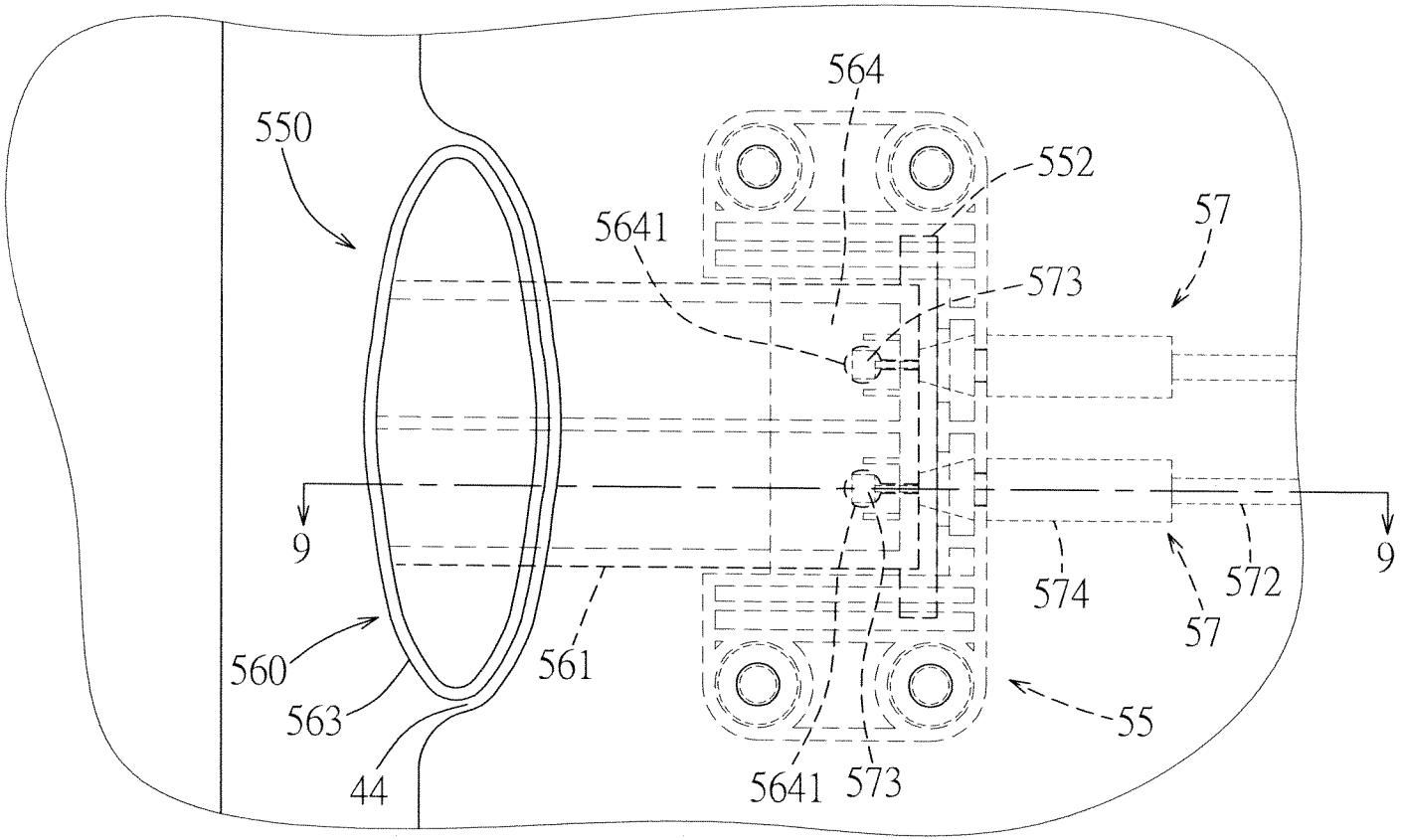
FIG. 8 is a fragmentary enlarged view of the first readily releasable locking device shown in FIG. 2.

As shown in FIGS. 8 and 9, the mounting wall 554 is formed with an elongated groove 552, and the lever-fulcrum region 562 is pivotally mounted in the elongated groove 552.

Referring back to FIGS. 1 to 3, in this embodiment, the desk includes two desk supports 1, two elongated shells 23, and a framework 2 which includes forward and rearward connecting rods 211, 212 that are spaced apart from each other in the forward-and-rearward direction (D1). Each of the forward and rearward connecting rods 211, 212 extends in the left-and-right direction (D2) to terminate at left and right rod ends which are fixed to the two elongated shells 23, respectively. The movable flat board 4 is hinged to the forward connecting rod 211 by two hinge members 22 so as to permit the movable flat board 4 to move linearly with the elongated shells 23. The movable flat board 4 has a cut-out portion 44 through which the power end 563 of the angular lever 560 is visible from a top side of the desk 100. Accordingly, a user can readily exert a force on the power end 563 of the angular lever 560 to angularly displace the movable flat board 4 to a desired tilt angle.

Furthermore, the first readily releasable locking device 5 includes two of the locking units 520. In each locking unit 520, two second link bars 50 (only one is shown in FIG. 1) are included, each of which is fixed to the rearward connecting rod 212, to thereby be fixed to the elongated shells 2, and the left and right side walls 5241, 5242 of the first hollow block 52 are respectively pivoted to the second pivot ends 501 of the second link bars 50. The first actuating unit 550 includes two cord members 57 (see FIG. 3). As shown in FIG. 8, the weight end 564 of the angular lever 560 has two engaging bores 5641, by which the weight end 564 can be actuated to pull both of the pulled ends 573 of the pull cords 570 to thereby actuate both of the first latch members 53 of the two locking units 520.

With reference to FIG. 3, the second readily releasable locking device 6 is used for guarding against a linear movement of the linearly movable elongated shells 23 relative to the non-movable tubular core members 111 of the desk supports 1. The second readily releasable locking device 6 includes two second locking units 620 which are disposed in the elongated shells 23, respectively. For the sake of brevity, only one second locking unit 620 and one elongated shell 23 are described below.

Figure 15:
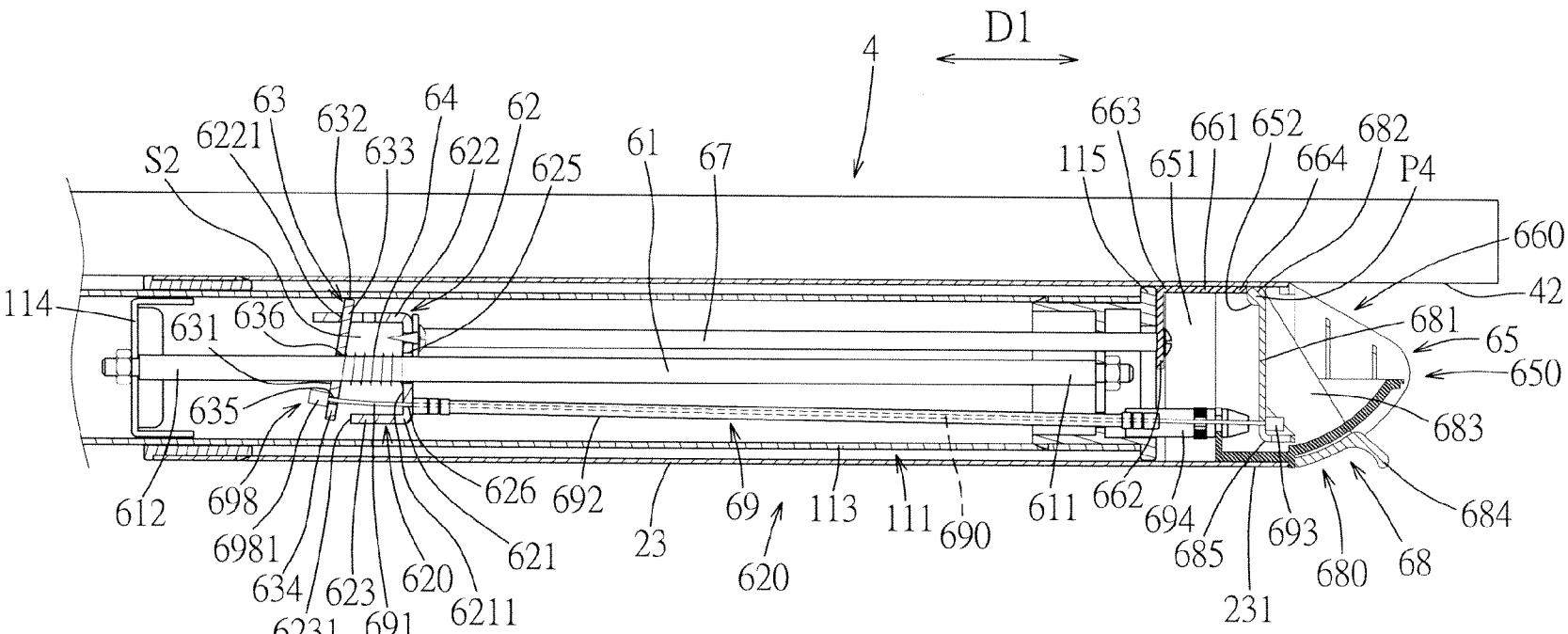
FIG. 15 is a schematic fragmentary enlarged sectional side view showing the second readily releasable locking device of FIG. 13.

As best shown in FIG. 15, the second locking unit 620 includes an under mounting frame 660, front and rear mounting frames 115, 114, a guiding bar 61, a second hollow block 62, a connecting rod 67, a second latch member 63, a second biasing member 64, and a second actuating unit 650.

The under mounting frame 660 is secured to the elongated shell 23. The front and rear mounting frames 115, 114 are secured to an inner surface of the front segment 113 of the tubular core member 111, and are spaced apart from each other in the forward-and-rearward direction (D1).

The guiding bar 61 extends in the forward-and-rearward direction (D1) to terminate at front and rear ends 611, 612 which are secured to the front and rear mounting frames 115, 114, respectively.

The second hollow block 62 is configured to be guided by and movable relative to the guiding bar 61 between a rear position (FIGS. 13, 15), where the second hollow block 62 is close to the rear mounting frame 114, and which corresponds to the retracted position of the elongated shell 23, and a front position (FIG. 22), where the second hollow block 62 is remote from the rear mounting frame 114, and which corresponds to the extended position of the elongated shell 23.

The connecting rod 67 extends through the front mounting frame 115 to connect the under mounting frame 660 and the second hollow block 62, thereby permitting the second hollow block 62 to be moved with the elongated shell 23.

The second latch member 63 is disposed in the second hollow block 62 and is coupled with the guiding bar 61 such that the second latch member 63 is displaceable between a first orientation (FIG. 15), where the second latch member 63 together with the second hollow block 62 is retained on the guiding bar 61, and a second orientation (FIG. 21), where the second latch member 63 together with the second hollow block 62 is movable relative to the guiding bar 61.

Figure 16:
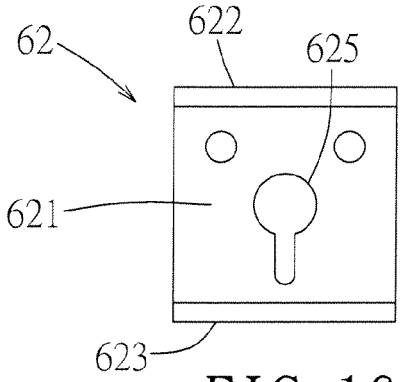
FIG. 16 is a side view of a second hollow block of the second readily releasable locking device.
Figure 17:
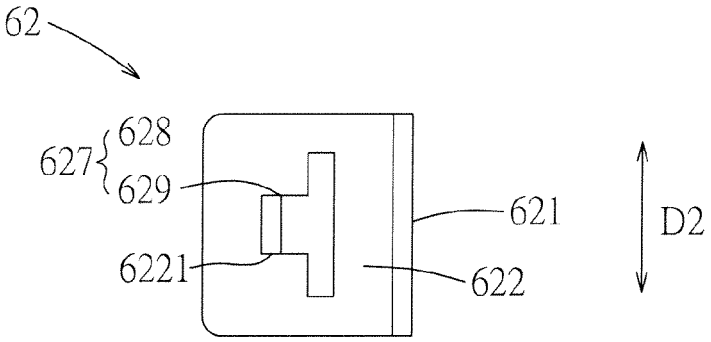
FIG. 17 is another side view of the second hollow block.

As best shown in FIGS. 15 to 17, the second hollow block 62 has a front wall 621, an upper support wall 622, and a lower limit wall 623. The front wall 621 has a rear abutment surface 6211 and is formed with a through bore 625 through which the guiding bar 61 extends. The upper support wall 622 defines an abutment surface 6221. The lower limit wall 623 defines a limit surface 6231, and is spaced apart from the upper support wall 622 by an accommodation space (S2).

Figure 18:
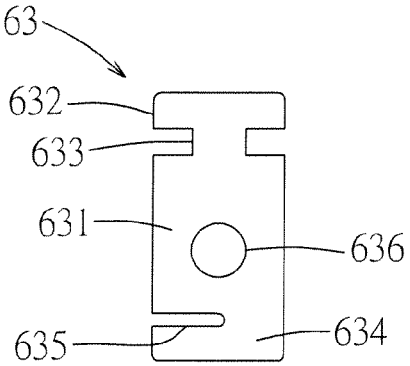
FIG. 18 is a plan view of a second latch member of the second readily releasable locking device.

As best shown in FIGS. 15 and 18, the second latch member 63 has a fulcrum region 633, a power region 634, and a weight region 631. The fulcrum region 633 is held on by the abutment surface 6221. The power region 634 is disposed to be actuated by the second actuating unit 650 to move between an engaged position (FIG. 21), where the power region 634 abuts against the limit surface 6231, and which corresponds to the second orientation of the second latch member 63, and a disengaged position (FIG. 15) which corresponds to the first orientation of the second latch member 63. The weight region 631 is disposed between the fulcrum region 633 and the power region 634, and has a gate hole 636 through which the guiding bar 61 extends, and which is configured such that when the power region 634 is in the disengaged position (FIG. 15), the weight region 631 is retained on the guiding bar 61, and such that when the power region 634 is in the engaged position (FIG. 21), the weight region 631 is released from being retained on the guiding bar 61.

Referring further to FIGS. 15, 17, and 18, the second latch member 63 further has a head region 632 which extends from the fulcrum region 633 and outwardly of the second hollow block 62. The fulcrum region 633 is configured to be narrower than the head region 632 and the weight region 631 so as to serve as a neck of the second latch member 63. The upper support wall 622 has an engaging hole 627 which has a larger-dimension hole segment 628 and a smaller-dimension hole segment 629 bordered by the abutment surface 6221. The second latch member 63 is inserted into the accommodation space (S2) through the larger-dimension hole segment 628, such that the fulcrum region 633 is fitted into the smaller-dimension hole segment 629 to thereby be held on by the abutment surface 6221.

The second biasing member 64 is disposed in the second hollow block 62 to bias the second latch member 63 to the first orientation (FIG. 15). In this embodiment, the second biasing member 64 is a spring sleeved on the guiding bar 61 and is disposed between the rear abutment surface 6211 and the weight region 631 to bias the latch member 63 to the first orientation.

The second actuating unit 650 is configured to actuate the second latch member 63 to move from the first orientation to the second orientation. The second actuating unit 650 includes a cord member 69 and a manually operable actuator 68.

The cord member 69 includes a pull cord 690. The pull cord 690 has a pulled end 693, and a cord body 691 extending from the pulled end 693 in the forward-and-rearward direction (D1) through the front mounting frame 115 and the front wall 621 to terminate at an anchor end 698 which is connected to the power region 634 of the second latch member 63. The anchor end 698 has an enlarged head 6981, and the power region 634 is formed with a slit 635 for insertion of the cord body 691 so as to permit the enlarged head 6981 to be brought into abutting engagement with the power region 634, thereby allowing the power region 634 to be pulled to the engaged position (FIG. 21).

In this embodiment, the cord member 69 further includes a tubular sheath 692 into which the cord body 691 is inserted loosely, and a tubular fitting 694 (see FIG. 15). The tubular sheath 692 is flexible for guiding and protecting the cord body 691 therein. The tubular fitting 694 extends through and is mounted in the front mounting frame 115. Besides, the tubular fitting 694 is rigid, and is configured to permit the cord body 691 to pass therethrough and to move relative thereto.

Figure 21:
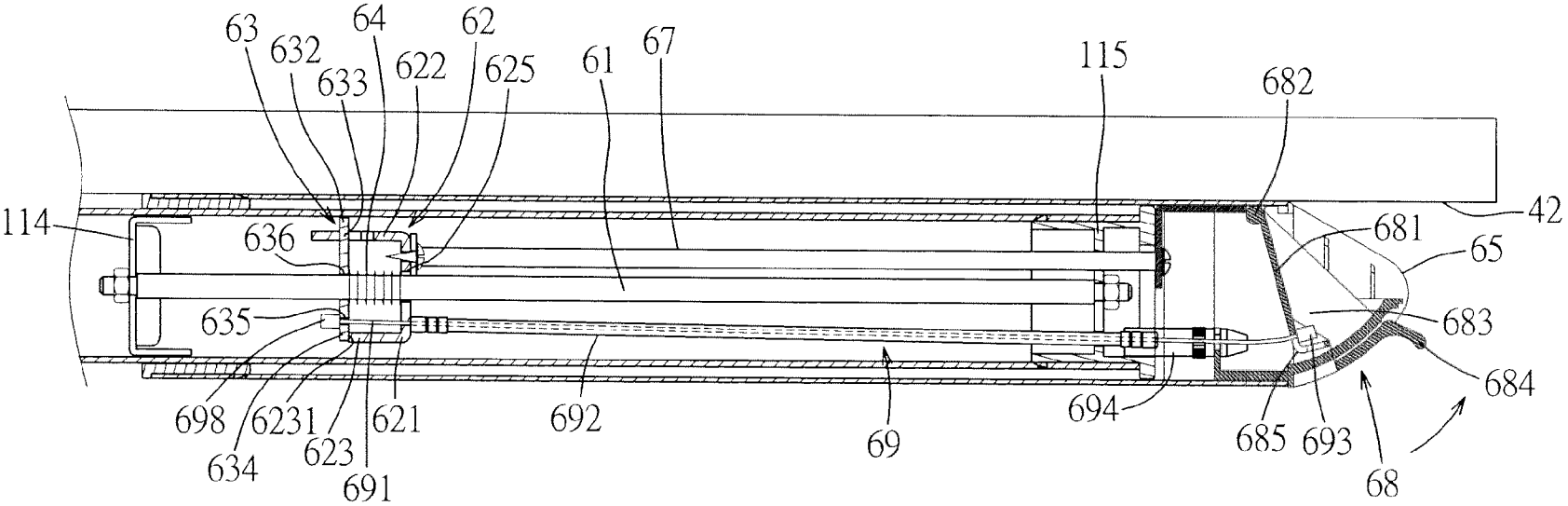
FIG. 21 is similar to FIG. 15 but showing the second latch member in a second orientation.

The manually operable actuator 68 is disposed to actuate the pulled end 693 to transmit a pulling force to the anchor end 698 so as to pull the power region 634 from the disengaged position (FIG. 15) to the engaged position (FIG. 21).

With reference to FIG. 15, the under mounting frame 660 has a longitudinal mounting wall 661, a transverse mounting wall 662, and a covering member 65. The longitudinal mounting wall 661 is secured to the elongated shell 23 and extends in the forward-and-rearward direction (D1) to terminate at front and rear wall ends 664, 663. The transverse mounting wall 662 extends downwardly from the rear wall end 663. The connecting rod 67 is configured to connect the transverse mounting wall 662 and the second hollow block 62. The covering member 65 is secured to the elongated shell 23 and is configured to cover a front open end 231 of the elongated shell 23.

Figure 20:
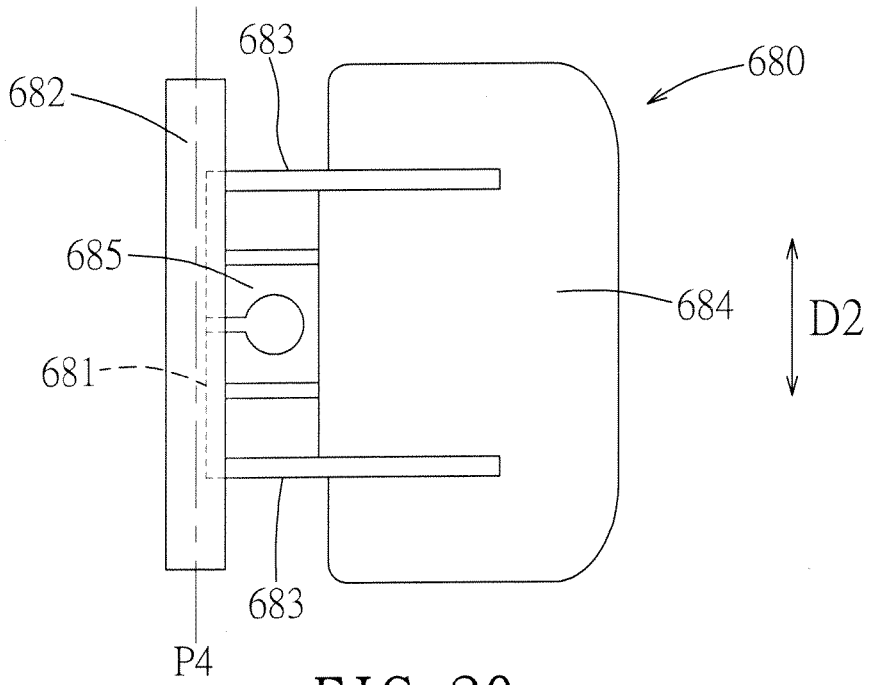
FIG. 20 is a top view of an angular lever of the second readily releasable locking device.

The manually operable actuator 68 has an angular lever 680. The angular lever 680 has a fulcrum end 682, a power end 684, and a weight end 685. The fulcrum end 682 is pivotally mounted to the covering member 65 of the under mounting frame 660 about a fourth pivot axis (P4) in a position adjacent to the front wall end 664 of the longitudinal mounting wall 661. The weight end 685 is angularly displaced from the power end 684 about the fourth pivot axis (P4), and is configured to anchor the pulled end 693 such that when the power end 684 is pushed to move angularly about the fourth pivot axis (P4), the weight end 685 is actuated to pull the pulled end 693. As shown in FIGS. 15 and 20, the angular lever 680 further has an arm portion 681 and two web portions 683. The arm portion 681 extends radially from the fulcrum end 682 to connect with the weight end 685. The web portions 683 are spaced apart from each other in the left-and-right direction (D2), and each of the web portions 683 extends radially from the fulcrum end 682 to connect the arm portion 681 and the power end 684.

Figure 19:
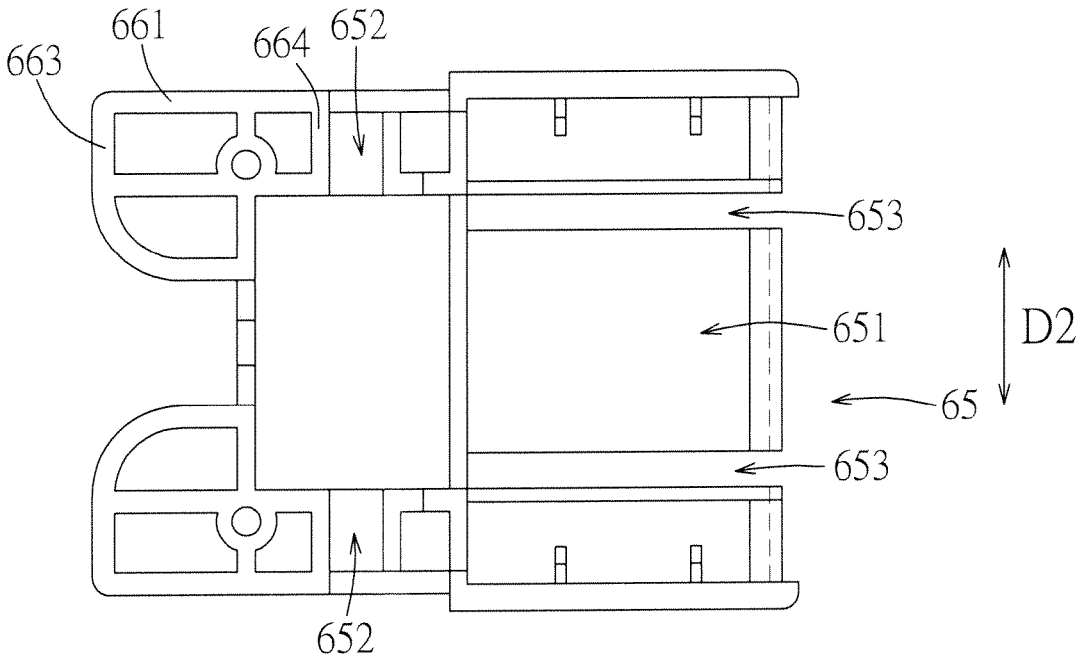
FIG. 19 is a top view of a covering member of the second readily releasable locking device.

In this embodiment, as shown in FIGS. 15 and 19, the covering member 65 is formed with two pivot grooves 652 in a position adjacent to the front wall end 664. The under mounting frame 660 defines an inner space 651 therein for accommodating the angular lever 680 and the tubular fitting 694. As shown in FIG. 20, the fulcrum end 682 is in the shape of a rod. Two rod ends of the rod 682 are respectively received in the pivot grooves 652 to permit the angular lever 680 to be pivotally mounted to the covering member 65. In addition, the power end 684 is disposed outwardly of the covering member 65, and the covering member 65 is further formed with two slits 653 to permit the web portions 683 of the angular lever 680 to extend therethrough and to be swingable about the fourth pivot axis (P4). Because the power end 684 is disposed outwardly of the covering member 65, a user can readily exert a force on the power end 684 of the angular lever 680 to linearly displace the elongated shell 23 together with the flat board 4 to a desired position.

FIGS. 23 to 26 illustrate a second locking unit 620 of a second readily releasable locking device 6 according to a second embodiment of the disclosure. The second embodiment is similar to the first embodiment except that a second hollow block 62' of the second embodiment is slightly different from that of the first embodiment.

The second hollow block 62' has a front wall 621 and an upper support wall 622. The front wall 621 is formed with a through bore 625' through which the guiding bar 61 extends. The upper support wall 622 has an engaging hole 627' which is defined by front and rear abutment surfaces 6222, 6223.

Figure 23:
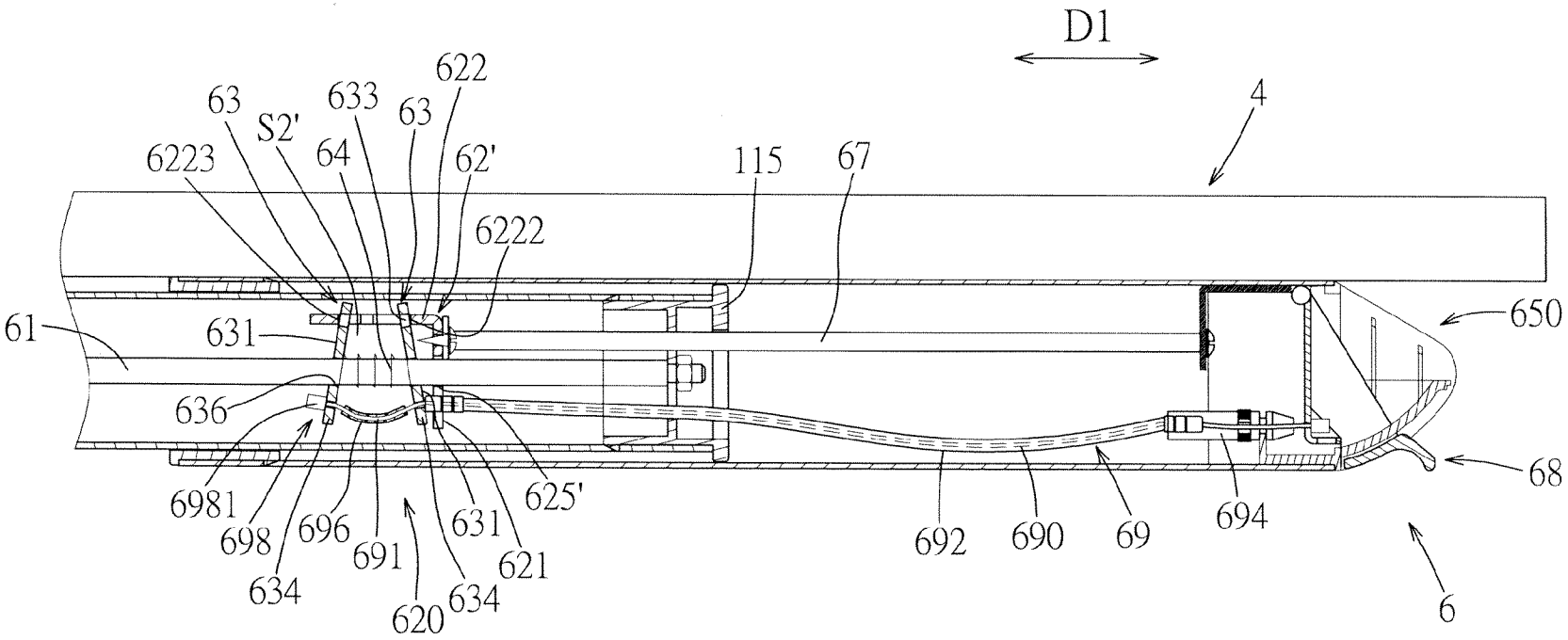
FIG. 23 is a schematic fragmentary enlarged sectional side view showing a second readily releasable locking device according to a second embodiment of the disclosure when used in a desk.
Figure 26:
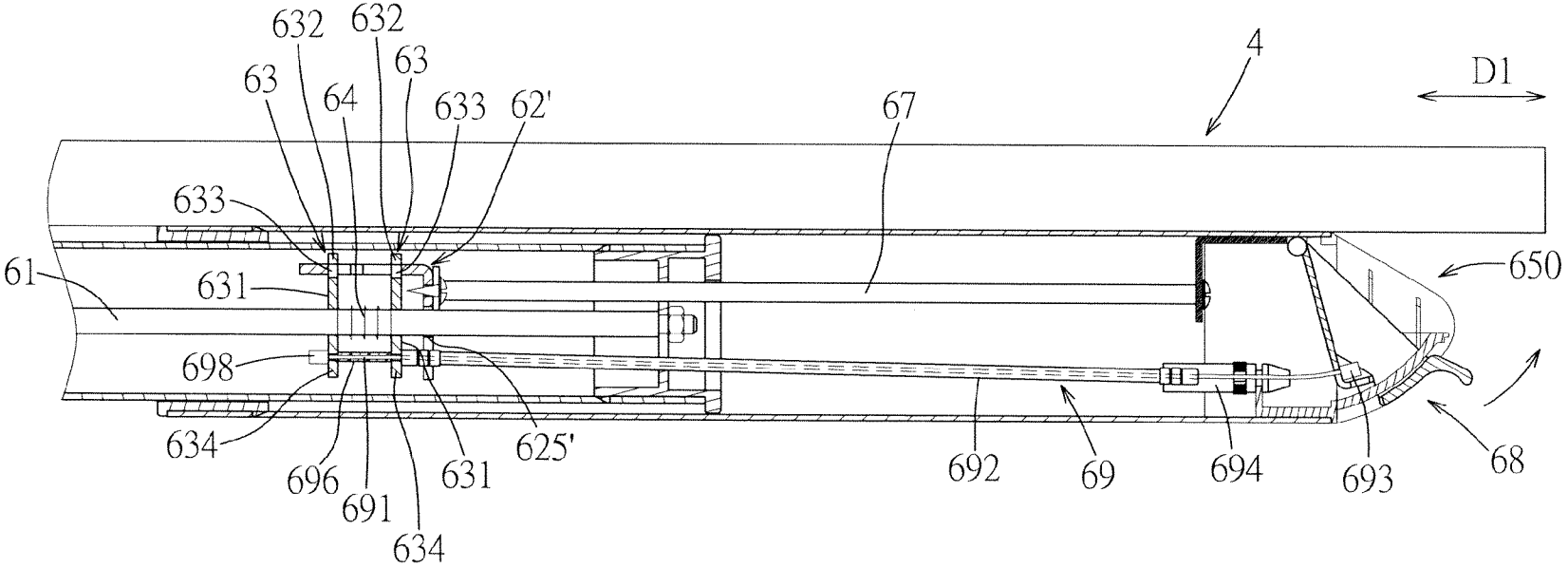
FIG. 26 is similar to FIG. 23 but showing two second latch members in a second orientation.

Furthermore, as shown in FIG. 23, two second latch members 63 are included. The second latch members 63 are disposed in the second hollow block 62' and are spaced apart from each other in the forward-and-rearward direction (D1). Each of the second latch members 63 is displaceable between the first orientation (FIG. 23) and the second orientation (FIG. 26), and has a structure substantially the same as that of the first latch member 53 of the first embodiment. Each of the second latch members 63 has a fulcrum region 633, a power region 634, and a weight end 631. The fulcrum region 633 of each second latch member 63 is held on by a corresponding one of the front and rear abutment surfaces 6222, 6223. The power region 634 of each second latch member 63 is disposed to be actuated by the second actuating unit 650 to move between a normal position, where the power regions 634 of the second latch members 63 are away from each other, and which corresponds to the first orientation (FIG. 23), and a pressed position, where the power regions 634 of the second latch members 63 are closer to each other, and which corresponds to the second orientation (FIG. 26). The weight region 631 of each second latch member 63 is disposed between the fulcrum region 633 and the power region 634, and has a gate hole 636 through which the guiding bar 61 extends, and which is configured such that when the power region 634 is in the normal position (FIG. 23), the weight region 631 is retained on the guiding bar 61, and such that when the power region 634 is in the pressed position (FIG. 26), the weight region 631 is released from being retained on the guiding bar 61.

In the second embodiment, each of the second latch members 63 further has a head region 632 which extends from the fulcrum region 633 and outwardly of the second hollow block 62'. The fulcrum region 633 is configured to be narrower than the head region 632 and the weight region 631 so as to serve as a neck of the second latch member 63.

Figure 24:
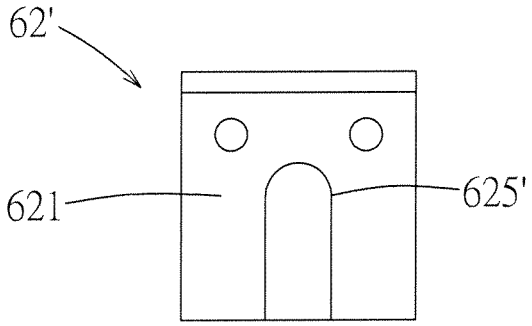
FIG. 24 is a side view of a second hollow block of the second readily releasable locking device shown in FIG. 23.
Figure 25:
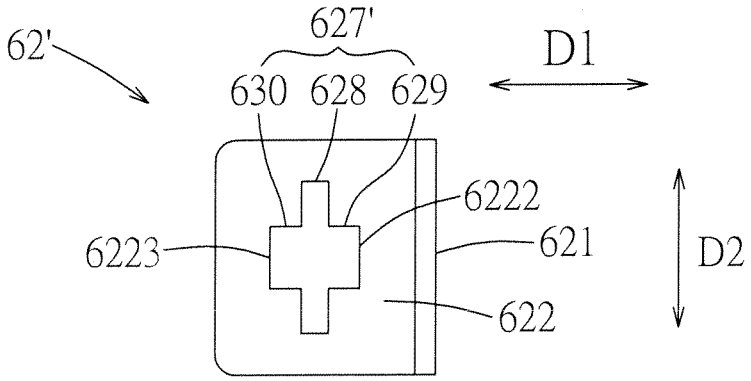
FIG. 25 is another side view of the second hollow block shown in FIG. 24.

As shown in FIGS. 23 to 25, in the second hollow block 62', an engaging hole 627' of the upper support wall 622 has a larger-dimension hole segment 628, a front smaller-dimension hole segment 629 bordered by the front abutment surface 6222, and a rear smaller-dimension hole segment 630 bordered by the rear abutment surface 6223. The second latch members 63 are inserted into an accommodation space S2' of the second hollow block 62' through the larger-dimension hole segment 628, such that the fulcrum region 633 of each second latch member 63 is fitted into a corresponding one of the front and rear smaller-dimension hole segments 629, 630 to thereby be held on by the corresponding one of the front and rear abutment surfaces 6222, 6223.

In this embodiment, the second biasing member 64 is disposed between the weight regions 631 of the latch members 63 to bias the second latch members 63 to the first orientation (FIG. 23).

Furthermore, in the second embodiment, the cord body 691 extends from the pulled end 693 in the forward-and-rearward direction (D1) through the front mounting frame 115, the front wall 621, and the power region 634 of a front one of the second latch members 63 to terminate at an anchor end 698 which is connected to the power region 634 of a rear one of the second latch members 63.

In the second embodiment, the second actuating unit 650 further includes a tubular spacer 696. The tubular spacer 696 is sleeved on the cord body 691 and is disposed between the power regions 634 of the second latch members 63. The tubular spacer 696 is configured such that when the power regions 634 of the second latch members 63 are in the pressed position (FIG. 26), the tubular spacer 696 is braced against the power regions 634.

In the second embodiment, the manually operable actuator 68 is disposed to actuate the pulled end 693 of the cord body 691 to transmit a pulling force to the anchor end 698 so as to pull the power region 634 of the rear one of the second latch members 63, thereby permitting the second latch members 63 to be displaced from the normal position to the pressed position.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A desk comprising a non-angularly movable elongated shell, an angularly movable flat board disposed to make continuous angular displacement relative to said non-angularly movable elongated shell between a laid-flat position and a lifted-up position, and a readily releasable locking device for guarding against an angular movement of said angularly movable flat board relative to said non-angularly movable elongated shell, said readily releasable locking device comprising:

a first link bar fixed on said angularly movable flat board and having a first pivot end distal from said angularly movable flat board;

a second link bar fixed on said non-angularly movable elongated shell and having a second pivot end distal from said non-angularly movable elongated shell;

a hollow block pivotally mounted to said second pivot end about a second pivot axis, and having a guiding slot which extends transverse to the second pivot axis;

a guided rod having a connected end pivotally mounted to said first pivot end about a first pivot axis parallel to the second pivot axis, and a rod body extending from said connected end along a lengthwise line to terminate at a free end, said rod body being led to pass through said guiding slot and to extend outwardly of said hollow block, so as to permit said guided rod to be moved relative to said hollow block between a proximate position, where said hollow block is proximate to said first pivot end, and which corresponds to the laid-flat position of said angularly movable flat board, and a distal position, where said hollow block is distal from said first pivot end, and which corresponds to the lifted-up position of said angularly movable flat board;

a latch member disposed in said hollow block and coupled with said guided rod such that said latch member is displaceable between a first orientation, where said guided rod is retained by said latch member, and a second orientation, where said guided rod is permitted to move relative to said latch member;

a biasing member disposed in said hollow block to bias said latch member to the first orientation; and an actuating unit configured to actuate said latch member to move from the first orientation to the second orientation.

2. The desk according to claim 1, wherein said hollow block has a top wall having an inner abutment surface and said guiding slot which extends through said inner abutment surface, a side support wall defining an abutment surface, and a side limit wall defining a limit surface, and spaced apart from said side support wall by an accommodation space, said latch member having a fulcrum region held on by said abutment surface, a power region disposed to be actuated by said actuating unit to move between an engaged position, where said power region abuts against said limit surface, and which corresponds to the second orientation of said latch member, and a disengaged position which corresponds to the first orientation of said latch member, and a weight region disposed between said fulcrum region and said power region, and having a gate hole through which said guided rod extends, and which is configured such that when said power region is in the disengaged position, said rod body is retained in said gate hole, and such that when said power region is in the engaged position, said rod body is released from being retained in said gate hole.

3. The desk according to claim 2, wherein said biasing member is sleeved on said rod body and disposed between said inner abutment surface and said weight region to bias said latch member to the first orientation.

4. The desk according to claim 3, wherein said actuating unit includes a pull cord having a pulled end, and a cord body extending from said pulled end through said top wall to terminate at an anchor end which is connected to said power region of said latch member, and a manually operable actuator disposed to actuate said pulled end to transmit a pulling force to said anchor end so as to pull said power region from the disengaged position to the engaged position.

5. The desk according to claim 4, wherein said anchor end has an enlarged head, and said power region is formed with a slit for insertion of said cord body therethrough so as to permit said enlarged head to be brought into abutting engagement with said power region, thereby allowing said power region to be pulled to the engaged position.

6. The desk according to claim 1, wherein said manually operable actuator has a holding member having an upright wall which extends from said angularly movable flat board to terminate at a lower end, and which is configured to permit said cord body to be moved relative to said upright wall, and amounting wall extending from said lower end transverse to said upright wall, and an angular lever having a lever-fulcrum region pivotally mounted to said mounting wall about a third pivot axis, a power end, and a weight end which is angularly displaced from said power end about the third pivot axis, and which is configured to anchor said pulled end such that when said power end is pushed to move angularly about the third pivot axis, said weight end is actuated to pull said pulled end, said angular lever further having a web portion which interconnects said power end and said weight end for reinforcement.

7. The desk according to claim 2, wherein said latch member further has a head region which extends from said fulcrum region and outwardly of said hollow block, said fulcrum region being configured to be narrower than said head region, said side support wall having an engaging hole which has a larger-dimension hole segment and a smaller-dimension hole segment bordered by said abutment surface, said latch member being inserted into said accommodation space through said larger-dimension hole segment such that said fulcrum region is fitted into said smaller-dimension hole segment to thereby be held on by said abutment surface.

* * * * *